US005458517A

United States Patent [19]

Ellis

[11] Patent Number: 5,458,517

[45] Date of Patent: Oct. 17, 1995

[54] FLOAT WITH SUN SHADE

[76] Inventor: Catherine L. Ellis, P.O. Box 242, Holder, Fla. 34445

[21] Appl. No.: 288,015

[22] Filed: Aug. 10, 1994

[51] Int. Cl.[6] ..... B63C 9/08

[52] U.S. Cl. ..... 441/129; 441/40

[58] Field of Search ..... 114/345, 361; 441/40, 66, 129, 38, 136; 5/455, 414; 4/496, 494

[56] References Cited

U.S. PATENT DOCUMENTS

| | | | |
|---|---|---|---|
| 2,854,014 | 9/1958 | Hasselquist | 441/40 |
| 3,432,182 | 3/1969 | Solipasso | 441/40 |
| 4,907,997 | 3/1990 | Hall | 441/40 |
| 4,996,733 | 3/1991 | Tsai | 5/414 |
| 5,233,705 | 8/1993 | Coleman et al. | 441/129 |

*Primary Examiner*—Edwin L. Swinehart

[57] ABSTRACT

A float with sun shade including an inflatable raftlike flotation device comprising a series of communicating compartments wherein an outermost compartment pair is extendedly formed into a sun shade support. A sun shade comprising a fixed portion and an adjustable portion is affixed to the sun shade support. In use, a human lying upon the raftlike flotation device is shielded in part from direct solar radiation by the fixed portion of the sun shade and furthermore additional shading may be achieved by an appropriate disposition of the adjustable portion.

5 Claims, 4 Drawing Sheets

FLOAT WITH SUN SHADE

BACKGROUND OF THE INVENTION

1. Field of the Invention

The present invention relates to recreational flotation devices and more particularly pertains to a float with sun shade which may be employed to float a human on a body of water while simultaneously providing shade from the sun for a portion of the human.

2. Description of the Prior Art

The use of rafts and flotation devices is known in the prior art. More specifically, rafts and flotation devices heretofore devised and utilized for flotation of a human body upon a body of water are known to consist basically of familiar, expected and obvious structural configurations, notwithstanding the myriad of designs encompassed by the crowded prior art which have been developed for the fulfillment of countless objectives and requirements.

The present invention is directed to improving devices for a float with sun shade in a manner which is safe, secure, economical and aesthetically pleasing.

For example, U.S. Pat. No. 4,894,033 to Chang discloses a multipurpose and inflatable raft. The Chang invention comprises an inflatable circular raft unit, an inflatable spherical raft unit, and an inflatable back seat wherein each raft unit has several retainer plates disposed thereon for the purpose of interconnection and providing a raft of high buoyancy susceptible to introduction of a pedaling device. The Chang invention has no provision for shielding humans disposed thereupon from sunlight. The present invention comprises a raftlike floatation device having a sun screening provision for all or portions of a human disposed thereupon.

In U.S. Pat. No. 5,049,102 to Hull a recreational raft apparatus is disclosed comprising an inflatable raft portion with an inflatable pillow and at least one closable pocket portion, and furthermore includes a clip fastened towel cover for the topmost side of the invention. There is no provision in the Hull invention for shading the user from sunlight. The present invention comprises an inflatable raft having a sun shade which screens potentially harmful sunlight from a human disposed thereupon.

In U.S. Pat. No. 4,750,447 to Spinosa et al. an inflatable life raft is disclosed comprising an inflatable passenger receptacle having a removable canopy for covering the passenger receptacle. The Spinosa et al. invention treats a non-recreational life raft having pockets for survival gear and automated inflation devices, and furthermore the user of the Spinosa et al invention is disposed therein in a substantially seated position wherein the raft conforms to the buttocks, back, and legs of the user. The Spinosa invention has a plurality of bleeder cords in communicating air chambers thereby facilitating inflation and deflation during emergencies. The removable canopy is devised to protect the user from the effects of waves and high winds and, although effective as a sunshade, does not provide for free air flow therethrough wherein the user is susceptible to extreme discomfort and dehydration if the Spinosa et al. raft is used for recreational purposes in warm weather. The present invention comprises a substantially planar inflatable raft having a sun shade disposed upon an inflatable raft portion thereof. The sun shade of the present invention may be an inflatable section or an unrolling shade, or a meshlike screen susceptible to blocking a portion of sunlight passing therethrough yet permitting substantially free passage of breezes.

In U.S. Pat. No. 4,127,909 to Pizzo an inflatable raft construction and method is disclosed for simplified construction of substantially right angle tubular joints in inflatable rafts. A disadvantage in this prior art lies in a lack of provision for attaching a sun shade to a raft so constructed, and furthermore the Pizzo invention requires substantially orthogonal disposition of tubular communicating raft portions. The present invention requires disposition of a sun shade upon a portion of the raft structure and additionally the present invention does not generally employ orthogonally disposed communicating tubular portions.

U.S. Pat. No. 5,205,086 to Heim discloses an inflatable tent. The disclosure teaches a tent having a flexible canopy, a floor, and a series of inflatable tubes serving as frame hoops. The disclosure makes no provision for flotation of humans for recreational purposes. Furthermore, there are no provisions for a partial enclosure forming a sun shade. The present invention comprises a raftlike inflatable flotation device having a fixed or deployable sun shade disposed thereon.

In this respect, the float with sun shade according to the present invention substantially departs from the conventional concepts and designs of the prior art, and in so doing provides an apparatus primarily developed for the purpose of providing recreational flotation of humans with substantial protection from sunlight.

Therefore, it can be appreciated that there exists a continuing need for new and improved floats with sun shades which can be employed for recreational human flotation without the potentially adverse action of sunlight. In this regard, the present invention substantially fulfills this need.

As illustrated by the background art, efforts are continuously being made in an attempt to improve raftlike flotation devices. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of rafts, and inflatable flotation devices now present in the prior art, the present invention provides an improved float with sun shade construction wherein the same can be utilized for recreational human flotation in direct sunlight while shielding the human at least in part from receiving a significant solar radiation dosage. As such, the general purpose of the present invention, which will be described subsequently in greater detail, is to provide a new and improved float with sun shade apparatus and method which has all the advantages of the prior art rafts and human flotation devices and none of the disadvantages.

The invention is defined by the appended claims with the specific embodiment shown in the attached drawings. For the purpose of summarizing the invention, the invention may be incorporated into an air inflatable raftlike flotation device having a canopy disposed over a portion thereof wherein the canopy comprises a member susceptible to blocking a substantial portion of sunlight whereby an user may enjoy flotation for extended periods without receiving a significant dosage of solar radiation. The canopy may comprise a detachable meshlike screen, an opaque flexible panel, or a translucent solar radiation filtering panel.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide an improved float with sun shade wherein a flotation device is equipped with a sun shade for the purpose of limiting human solar exposure of individual users thereof.

It is therefore an additional object of the present invention to provide a new and improved float with sun shade which has all the advantages of the prior art rafts and flotation devices and none of the disadvantages.

It is another object of the present invention to provide a new and improved float with sun shade which may be easily and efficiently manufactured and marketed.

It is a further object of the present invention to provide a new and improved float with sun shade which is of a durable and reliable construction.

An even further object of the present invention is to provide a new and improved float with sun shade which is susceptible of a low cost of manufacture with regard to both materials and labor, and which accordingly is then susceptible of low prices of sale to the consuming public, thereby making such float with sun shades economically available to the buying public.

Still yet another object of the present invention is to provide a new and improved float with sun shade which provides in the apparatuses and methods of the prior art some of the advantages thereof, while simultaneously overcoming some of the disadvantages normally associated therewith.

Still another object of the present invention is to provide a new and improved float with sun shade having a meshlike sun shade limiting the solar radiation passing therethrough whilst permitting substantially free flow of air therethrough.

Yet another object of the present invention is to provide a new and improved float with sun shade wherein the float portion is readily inflatable using foot and hand inflators, or other compressed air sources.

Even still another object of the present invention is to provide a new and improved float with sun shade wherein the sun shade portion is susceptible to removal or stowage within the float structure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
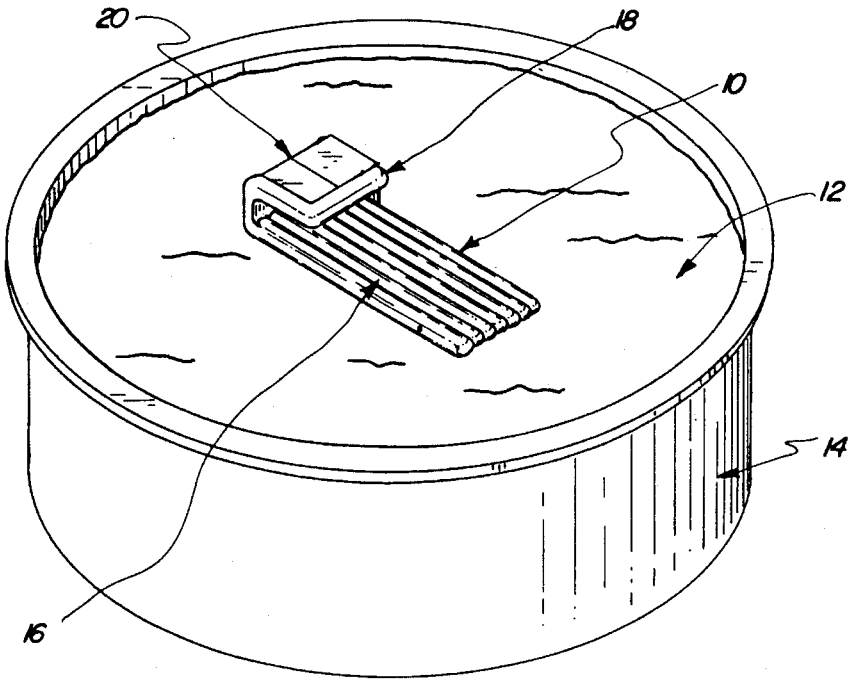
FIG. 1 is a perspective view of the float with sun shade showing flotation thereof within a swimming pool.

With reference now to the drawings, and in particular to FIG. 1 thereof, a new and improved float with sun shade embodying the principles and concepts of the present invention and generally designated by the reference numeral 10 will be described.

From an overview standpoint, the float with sun shade 10 is adapted for use with a body of water 12 such as pool 14. See FIG. 1. The float with sun shade 10 comprises a raftlike flotation portion 16 having disposed thereon a sun shade support portion 18 and a pull down sun shade 20. In use, a human lies upon the raftlike flotation portion 16 having their head positioned at an and of the raftlike flotation portion 16 substantially beneath the sun shade support portion 18 and manually moves pull down sun shade 20 to one side or another to effectively block sunlight from reaching the user's face.

Figure 2:
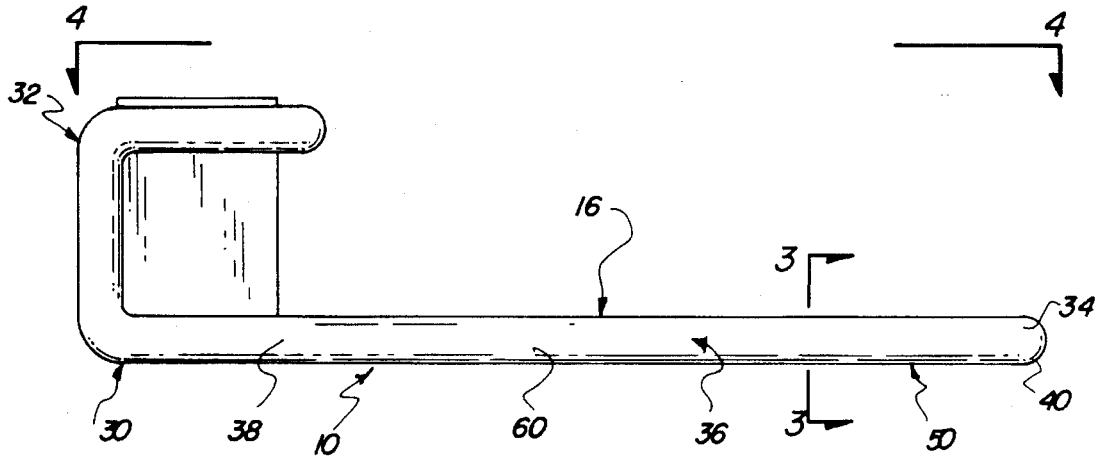
FIG. 2 is a side elevational view of the float with sun shade in a side shading position.
Figure 3:
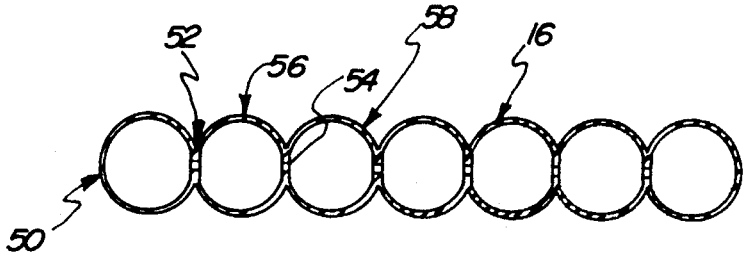
FIG. 3 is a side sectional view of a float with sun shade taken substantially upon the plane indicated by the section line 3—3 of FIG. 2.
Figure 6:
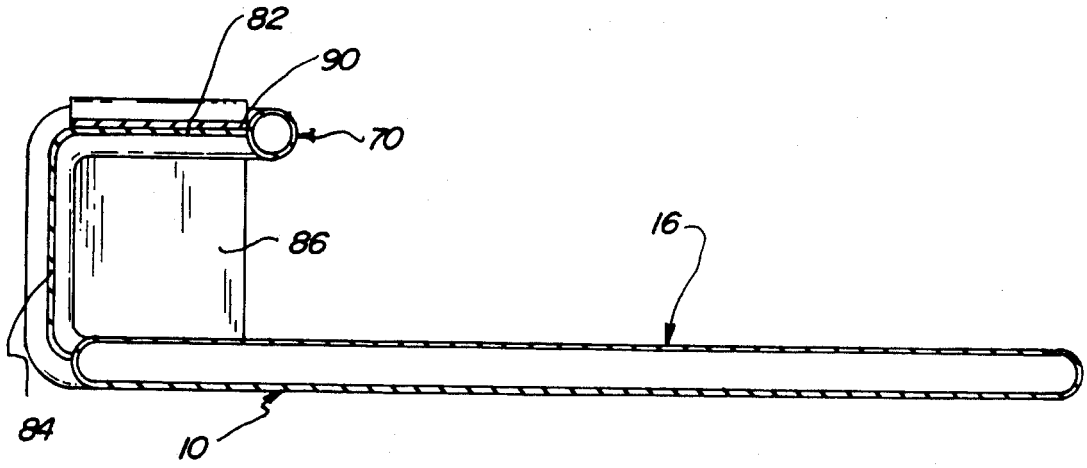
FIG. 6 is a side sectional view of the float with sun shade taken substantially upon the plane indicated by the section line 6—6 of FIG. 3.

More specifically, it will be noted that the float with sun shade 10 comprises raftlike flotation portion 16 which is formed into sun shade support portion 18 by a first ninety degree bend 30 and a second ninety degree bend 32. See FIG. 2. Raftlike flotation portion 16 comprises a multi-compartmented polymeric structure susceptible to being inflated by introduction of a volume of air therewithin. Raftlike portion 16 has a first end portion 34, a central portion 36, and a second end portion 38. First end portion 34 is a free end thereof and is rounded forming a smoothly curving terminating surface 40. Second end portion 38 terminates at first ninety degree bend 30 of sun shade support portion 18. Central portion 36 comprises a plurality of inflated communicating compartments 50 thereby providing a significant buoyant force adequate to furnish flotation of a human disposed thereupon. See FIG. 3. Communicating compartments 50 are bonded or otherwise joined at seams 52. Ports 54 disposed between adjoining compartments 56 and 58 permits air flow communicatively therethrough. Raftlike flotation portion 16 may be of vinyl or rubberized cloth composition, or any other construct which provides a durable inflatable platform substantially unaffected by water contact and sunlight impingement.

Figure 4:
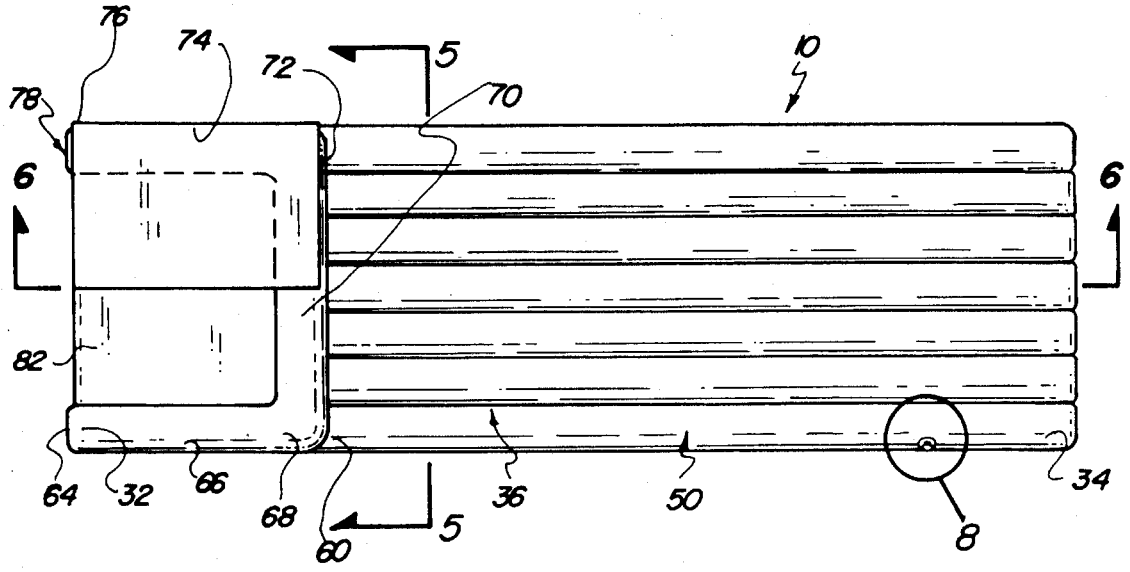
FIG. 4 is a side sectional view of a float with sun shade taken substantially upon the plane indicated by the section line 4—4 of FIG. 2.

Sun shade support portion 18 comprises an extension of a first compartment 60 and a second compartment 62 wherein first and second compartments 60 and 62 are the outermost of communicating compartments 50. See FIG. 4. First compartment 60 and second compartment 62 form sun shade support portion 18 by a framelike structure comprising first ninety degree bend 30, first tubular support portion 64, second ninety degree bend 32, second tubular support portion 66, third ninety degree bend 68, support interface tube 70, fourth ninety degree bend 72, third tubular support portion 74, fifth ninety degree bend 76, fourth tubular support portion 78, and sixth ninety degree bend 80. See FIG. 5. First ninety degree bend 30 and sixth ninety degree bend 80 comprise extensions of compartments 60 and 62 wherein a right angular bend is made thereto without substantial change in the free internal diameter of either compartment 60 or compartment 62.

First ninety degree bend 30 and sixth ninety degree bend 80 result in a substantially parallel disposition of first tubular support portion 64 and fourth tubular support portion 78, and furthermore result in a substantially orthogonal disposition of first tubular support portion 64 and fourth tubular support portion 78 with respect to a plane substantially containing a major surface of raftlike flotation portion 16. Second ninety degree bend 32 and fifth ninety degree bend 76 result in a substantially parallel disposition of second tubular support portion 66 and third tubular support portion 74, and furthermore result in a substantially parallel disposition of second tubular support portion 66 and third tubular support portion 74 with respect to a plane substantially containing a major surface of raftlike flotation portion 16. Third ninety degree bend 68 and fourth ninety degree bend 72 provide a disposition of support interface tube 70 wherein support interface tube 70 lies in a plane substantially parallel to a plane substantially containing a major surface of raftlike flotation portion 16.

Figure 5:
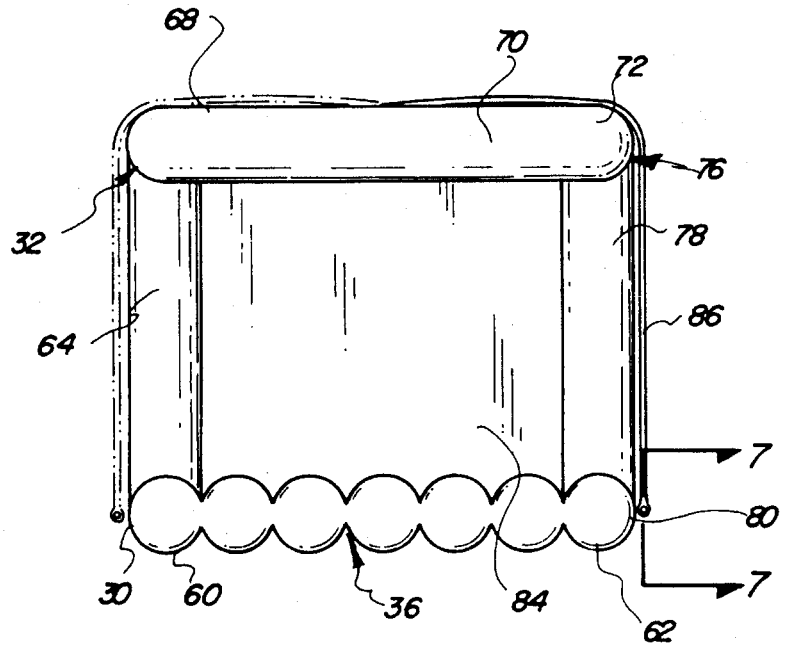
FIG. 5 is a side sectional view of a float with sun shade taken substantially upon the plane indicated by the section line 5—5 of FIG. 4.

Referring again to FIG. 4 and to FIG. 5 pull down sun shade 20 comprises a first fixed shade portion 82, a second fixed shade portion 84, and a pull down portion 86. Pull down sun shade 20 may be of polymeric composition such as a substantially opaque vinyl sheet or as a meshlike screen wherein the vinyl sheet blocks sunlight and air flow, and the meshlike screen blocks a portion of sunlight and permits some air flow therethrough. First fixed shade portion 82 is affixed to second tubular support portion 66, third ninety degree bend 68, support interface tube 70, fourth ninety degree bend 72, third tubular support portion 74 by a continuous bond thereto wherein the continuous bond may be a weld or adhesive fastening. Second fixed shade portion 84 is affixed to second ninety degree bend 32, first tubular support portion 64, first ninety degree bend 30, second end portion 38, sixth ninety degree bend 80, fourth tubular support portion 78, and fifth ninety degree bend 76 by a continuous bond thereto wherein the continuous bond may be a weld or adhesive fastening.

Figure 7:
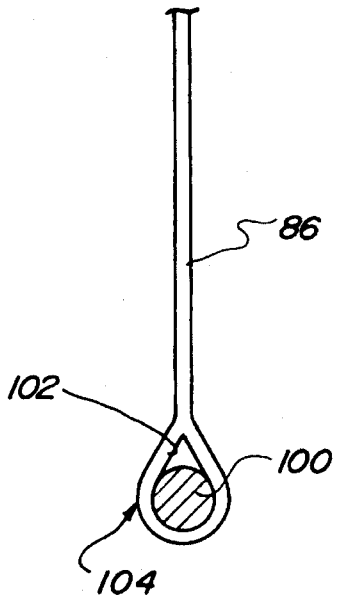
FIG. 7 is a fragmentary side sectional view of a float with sun shade taken substantially upon the plane indicated by the section line 7—7 of FIG. 5.

First fixed shade portion 82 and second fixed shade portion 84 are joined in continuity along a line substantially joining second ninety degree bend 32 and fifth ninety degree bend 76. Pull down portion 86 comprises a flexible sheetlike member of similar or differing composition to the first fixed shade portion 82 and second fixed shade portion 84. Pull down portion 86 is affixed along a single edge 90 to a centrally disposed region of first fixed shade portion 82 thereby permitting disposition,under user control, on either side of float with sun shade 10. Pull down portion 86 has a weight 100 disposed within a tubular portion 102 formed at a free end 104 thereof. See FIG. 7. Weight 100 may be an elongated rod of metallic composition or may be a quantity of granular material such as sand disposed within tubular portion 102 wherein the ends of tubular portion 102 are necessarily sealed to preclude sand loss therefrom.

Figure 8:
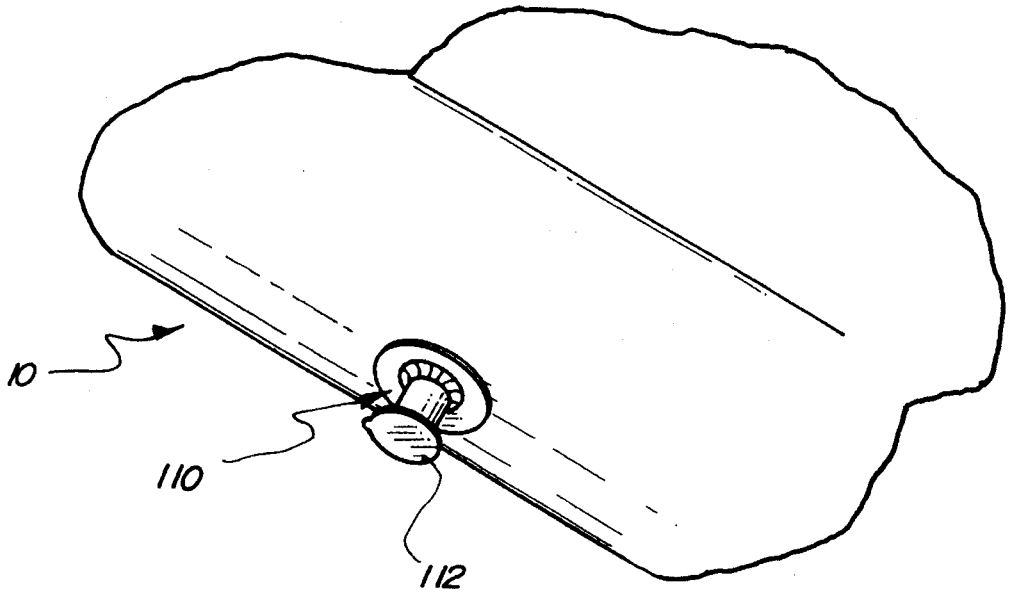
FIG. 8 is a fragmentary perspective view of a portion of the float with sun shade denoted by the numeral 8 of FIG. 4.

Inflation of the float with sun shade 10 is achieved by passage of air through port 110. See FIG. 8. Port 110 has a closure cap 112 exteriorly disposed thereon and furthermore has an internal check valve facilitating the maintenance of air therewithin, however the check valve must be bypassed to produce deflation.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

What is claimed as being new and desired to be protected by Letters Patent of the United States is as follows:

1. A float and sun shade for preventing portions of sunlight from reaching a human wherein the human is disposed upon a float comprising, in combination:

an inflatable floatation device comprising a plurality of elongated air fillable compartments bonded together thereby forming a surface and furthermore the air fillable compartments so bonded have a series of air passages communicatively disposed therebetween, the inflatable floatation device having an extension comprising a first right angle bend of a first extended elongated air fillable compartment and a second right angle bend of a second extended elongated air fillable compartment wherein the first and second elongated air fillable compartments being outermost compartments forming the inflatable floatation device, the floatation device integral with a first and second elongated further extension of the extended first and second extended elongated air fillable compartments, the extended first and second extended elongated air fillable compartments integral with a third right angle bend of the first elongated further extension and a fourth right angle bend of the second elongated further extension, the first and second elongated further extension integral with a third and fourth elongated further extension of the first and second elongated air fillable compartments, the first and second elongated air fillable compartments integral with a fifth right angle bend of the third elongated further extension and a sixth right angle bend of the fourth elongated further extension, the fourth elongated further extension integral with a singular elongated interface substantially forming an elongated fifth further extension of the first and second elongated air fillable compartments;

an adjustable means for blocking a portion of sunlight otherwise impinging upon the inflatable floatation device, the adjustable means supported by the extension of the inflatable floatation device, the adjustable means having a first fixed portion and a second adjustable portion, the first fixed portion affixed at edges thereof to the first right angle bend, the second right angle bend, the first elongated further extension, the second elongated further extension, the third right angle bend, the fourth right angle bend, the third elongated further extension, the fourth elongated further extension, the fifth right angle bend, the sixth right angle bend, and singular elongated interface, the second adjustable portion affixed at a first edge thereof to the first fixed portion along a centrally disposed narrow band in parallel disposition to the third elongated further extension and the fourth elongated further extension and furthermore the second adjustable portion having a weighting portion disposed along a second edge thereof wherein the second edge opposing the first edge.

2. The float with sun shade of claim 1 in which the shade member comprises a continuous sheet of polymeric material susceptible to precluding harmful solar radiation passage therethrough.

3. The float with sun shade of claim 1 in which the shade member comprises a mesh discontinuous sheet of material susceptible to precluding a portion of solar radiation passage therethrough wherein air flow therethrough is not substantially impeded.

4. The float with sun shade of claim 1 in which the weighting portion comprising an elongated rod member disposed within a hem portion of the second edge of the second adjustable portion.

5. The float with sun shade of claim 1 in which the weighting portion comprising a granular material of significant density disposed within a sealed hem portion of the second edge of the second adjustable portion wherein the hem portion is closed at free ends thereof.

* * * * *